US010364552B2

(12) United States Patent
Howell et al.

(10) Patent No.: US 10,364,552 B2
(45) Date of Patent: Jul. 30, 2019

(54) EXCAVATOR LINKAGE ANGLE DETERMINATION USING A LASER DISTANCE METER

(71) Applicant: Caterpillar Trimble Control Technologies LLC, Dayton, OH (US)

(72) Inventors: Mark Nicholas Howell, Christchurch (NZ); Samuel Joseph Frei, Christchurch (NZ)

(73) Assignee: Caterpillar Trimble Control Technologies LLC, Dayton, OH (US)

( * ) Notice: Subject to any disclaimer, the term of this patent is extended or adjusted under 35 U.S.C. 154(b) by 201 days.

(21) Appl. No.: 15/386,208

(22) Filed: Dec. 21, 2016

(65) Prior Publication Data

US 2018/0171597 A1 Jun. 21, 2018

(51) Int. Cl.

| | |
|---|---|
| ***E02F 3/32*** | (2006.01) |
| ***E02F 3/43*** | (2006.01) |
| ***E02F 9/22*** | (2006.01) |
| ***E02F 9/26*** | (2006.01) |

(52) U.S. Cl.

CPC ..... *E02F 9/265* (2013.01); *E02F 3/32* (2013.01); *E02F 3/435* (2013.01); *E02F 9/2271* (2013.01)

(58) Field of Classification Search

CPC ..... E02F 3/32; E02F 3/435; E02F 9/2271
USPC ..... 701/33.1
See application file for complete search history.

(56) References Cited

U.S. PATENT DOCUMENTS

| | | | |
|---|---|---|---|
| 4,829,418 | A | 5/1989 | Nielsen et al. |
| 6,253,160 | B1 | 6/2001 | Hanseder |
| 6,263,595 | B1 | 7/2001 | Ake |
| 2015/0330060 | A1 | 11/2015 | Seki et al. |
| 2016/0054114 | A1 | 2/2016 | Crozier et al. |

OTHER PUBLICATIONS

Trimble GCS900 Grade Control System for Excavators, Version 12.60, Revision A, Part Number, Feb. 2014.

*Primary Examiner* — Maceeh Anwari
(74) *Attorney, Agent, or Firm* — Dinsmore & Shohl LLP

(57) ABSTRACT

An excavator calibration framework comprises an excavator, a laser distance meter (LDM), and a laser reflector. The excavator comprises a linkage assembly (LA), implement, and controller. The LA comprises a boom with point B, stick coupled to point B, and four-bar linkage (4BL) including nodes D, F, G, and H (a dogbone linkage between nodes D and F). The laser reflector is disposed at node F. The nodes F, G, and the point B define an outer triangle BGF that defines with node D three inner triangles DGB, DBF, and DFG. The controller executes an iterative process including determining a node F position based on a LDM/laser reflector measurement signal, determining a node D position based on the node F position, and determining a dogbone angle BDF of DBF based on the node D position. The controller generates an actual dogbone angle based on a series of dogbone angles.

20 Claims, 4 Drawing Sheets

EXCAVATOR LINKAGE ANGLE DETERMINATION USING A LASER DISTANCE METER

BACKGROUND

The present disclosure relates to excavators which, for the purposes of defining and describing the scope of the present application, comprise an excavator boom and an excavator stick subject to swing and curl, and an excavating implement that is subject to swing and curl control with the aid of the excavator boom and excavator stick, or other similar components for executing swing and curl movement. For example, and not by way of limitation, many types of excavators comprise a hydraulically or pneumatically or electrically controlled excavating implement that can be manipulated by controlling the swing and curl functions of an excavating linkage assembly of the excavator. Excavator technology is, for example, well represented by the disclosures of U.S. Pat. No. 8,689,471, which is assigned to Caterpillar Trimble Control Technologies LLC and discloses methodology for sensor-based automatic control of an excavator, US 2008/0047170, which is assigned to Caterpillar Trimble Control Technologies LLC and discloses an excavator 3D laser system and radio positioning guidance system configured to guide a cutting edge of an excavator bucket with high vertical accuracy, and US 2008/0000111, which is assigned to Caterpillar Trimble Control Technologies LLC and discloses methodology for an excavator control system to determine an orientation of an excavator sitting on a sloped site.

BRIEF SUMMARY

According to the subject matter of the present disclosure, an excavator calibration framework comprises an excavator, a laser distance meter (LDM), and a laser reflector. The excavator comprises a machine chassis, an excavating linkage assembly, an excavating implement, and control architecture. The excavating linkage assembly comprises an excavator boom, and an excavator stick, and a four-bar linkage that collectively define a plurality of linkage assembly positions. The excavator stick is mechanically coupled to a terminal pivot point B of the excavator boom. The four-bar linkage comprises a node D, a node F, a node G, and a node H, and linkages disposed therebetween, the linkage between the nodes D and F defining a dogbone linkage. The LDM is configured to generate one or more measurement signals indicative of a distance and an angle between the LDM and the laser reflector. An outer triangle BGF is defined between the node F, the terminal pivot point B, and the node G. The outer triangle BGF comprises a first length BG, a second length $BF_i$, a third length $GF_i$. The node D is positioned within the outer triangle BGF and defines, with the outer triangle BGF, three inner triangles DGB, DBF, and DFG within the outer triangle BGF. The control architecture comprises one or more linkage assembly actuators and an architecture controller programmed to execute an iterative process. The iterative process comprises disposing the laser reflector at a position corresponding to the node F, generating a measurement signal indicative of a distance and an angle between the LDM and the laser reflector, determining a position of the node F based on the generated measurement signal, and determining the second length $BF_i$ and the third length $GF_i$ of the outer triangle BGF at least partially based on the position of the node F. The iterative process further comprises determining an angle BGD ($\theta_{BGD}$) of the inner triangle DGB at least partially based on the second length $BF_i$, and the third length $GF_i$ of the outer triangle BGF, determining a position of the node D at least partially based on the angle BGD ($\theta_{BGD}$), determining a length BD along the excavator stick between the terminal pivot point B and the node D at least partially based on the position of the node D, and determining a dogbone angle BDF ($\theta_{BDF}$) of the inner triangle DBF based on the length BD along the excavator stick, a dogbone length DF of the dogbone linkage of the four-bar linkage, and the second length $BF_i$ of the outer triangle BGF. The dogbone angle BDF ($\theta_{BDF}$) corresponds to an angular orientation of the dogbone linkage with respect to the length BD along the excavator stick. The architecture controller is further programmed to repeat the iterative process i times until i passes an iterative threshold, generate an actual dogbone angle BDF ($\theta_{BDF}^{actual}$) based on a series of dogbone angles BDF determined from the iterative process, and operate the excavator using the actual dogbone angle ($\theta_{BDF}^{actual}$).

In accordance with one embodiment of the present disclosure, an excavator calibration framework comprises an excavator, a laser distance meter (LDM), and a laser reflector. The excavator comprises a machine chassis, an excavating linkage assembly, an excavating implement, and control architecture. The excavating linkage assembly comprises an excavator boom, and an excavator stick, and a four-bar linkage that collectively define a plurality of linkage assembly positions. The excavator stick is mechanically coupled to a terminal pivot point B of the excavator boom. The four-bar linkage comprises a first node, a second node, a third node, and a fourth node with linkages disposed therebetween, the linkage disposed between the first node and the second node comprising a dogbone linkage. The LDM is configured to generate one or more measurement signals indicative of a distance and an angle between the LDM and the laser reflector. An outer triangle is defined between the second node, the terminal pivot point B, and the third node. The outer triangle comprises a first length between the terminal pivot point B and the third node of the four-bar linkage, a second length between the terminal pivot point B and the second node of the four-bar linkage, and a third length between the second node and the third node of the four-bar linkage. The first node is positioned within the outer triangle and defines, with the outer triangle, three inner triangles comprising a first inner triangle, a second inner triangle, and a third inner triangle within the outer triangle. The control architecture comprises one or more linkage assembly actuators and an architecture controller programmed to execute an iterative process. The iterative process comprises disposing the laser reflector at a position corresponding to the second node of the four-bar linkage, generating a measurement signal indicative of a distance and an angle between the LDM and the laser reflector, determining a position of the second node of the four-bar linkage based on the generated measurement signal, and determining the second length and the third length of the outer triangle at least partially based on the position of the second node of the four-bar linkage. The iterative process further comprises determining a first inner triangle angle of one of the first inner triangle defined between the terminal pivot point B, the terminal point G of the excavator stick, and the first node of the four-bar linkage at least partially based on the second length and the third length of the outer triangle, and determining a position of the first node of the four-bar linkage at least partially based on the first inner triangle angle. The iterative process further comprises determining an inner length along the excavator stick between the terminal pivot point B and the first node of the four-bar linkage at least partially based on the position of the first node of the four-bar linkage, and determining a dogbone angle defined by the second inner triangle, the second inner triangle formed from the inner length along the excavator stick, a dogbone length of the dogbone linkage of the four-bar linkage, and the second length of the outer triangle. The dogbone angle corresponds to an angular orientation of the dogbone linkage with respect to the inner length along the excavator stick. The architecture controller is further programmed to repeat the iterative process i times until i passes an iterative threshold, generate an actual dogbone angle based on a series of dogbone angles determined from the iterative process, and operate the excavator using the actual dogbone angle.

In accordance with another embodiment of the present disclosure, an excavator calibration framework comprises an excavator, a laser distance meter (LDM), and a laser reflector. The excavator comprises a machine chassis, an excavating linkage assembly, an excavating implement, and control architecture. The excavating linkage assembly comprises an excavator boom, and an excavator stick, and a four-bar linkage that collectively define a plurality of linkage assembly positions. The excavator stick is mechanically coupled to a terminal pivot point B of the excavator boom. The four-bar linkage comprises a node D, a node F, a node G, and a node H, and linkages disposed therebetween. The linkage between the nodes D and F defines a dogbone linkage. The laser reflector is disposed at a position corresponding to the node F. The nodes F, G, and the terminal pivot point B define an outer triangle BGF. The node D is positioned within the outer triangle BGF to define three inner triangles DGB, DBF, and DFG. The LDM is configured to generate one or more measurement signals indicative of a distance and an angle between the LDM and the laser reflector. The control architecture comprises one or more linkage assembly actuators and an architecture controller programmed to execute an iterative process. The iterative process comprises determining a position of the node F based on a generated measurement signal indicative of a distance and an angle between the LDM and the laser reflector, determining a position of the node D at least partially based on the position of the node F, and determining a dogbone angle BDF of the inner triangle DBF at least partially based on the position of the node D. The architecture controller is further programmed to repeat the iterative process i times until i passes an iterative threshold, generate an actual dogbone angle BDF based on a series of dogbone angles BDF determined from the iterative process, and operate the excavator using the actual dogbone angle.

Although the concepts of the present disclosure are described herein with primary reference to the excavator illustrated in FIG. 1, it is contemplated that the concepts will enjoy applicability to any type of excavator, regardless of its particular mechanical configuration. For example, and not by way of limitation, the concepts may enjoy applicability to a backhoe loader including a backhoe linkage.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

The present disclosure relates to earthmoving machines and, more particularly, to earthmoving machines such as excavators including components subject to control. For example, and not by way of limitation, many types of excavators typically have a hydraulically controlled earthmoving implement that can be manipulated by a joystick or other means in an operator control station of the machine, and is also subject to partially or fully automated control. The user of the machine may control the lift, tilt, angle, and pitch of the implement. In addition, one or more of these variables may also be subject to partially or fully automated control based on information sensed or received by an adaptive environmental sensor of the machine. In the embodiments described herein, an excavator calibration framework utilizes a laser distance meter to determine angles of linkages of excavator four-bar linkage components and sensor offsets of sensors disposed on such linkages, as described in greater detail further below. Such determined values may be utilized by an excavator control to operate the excavator.

Figure 1:
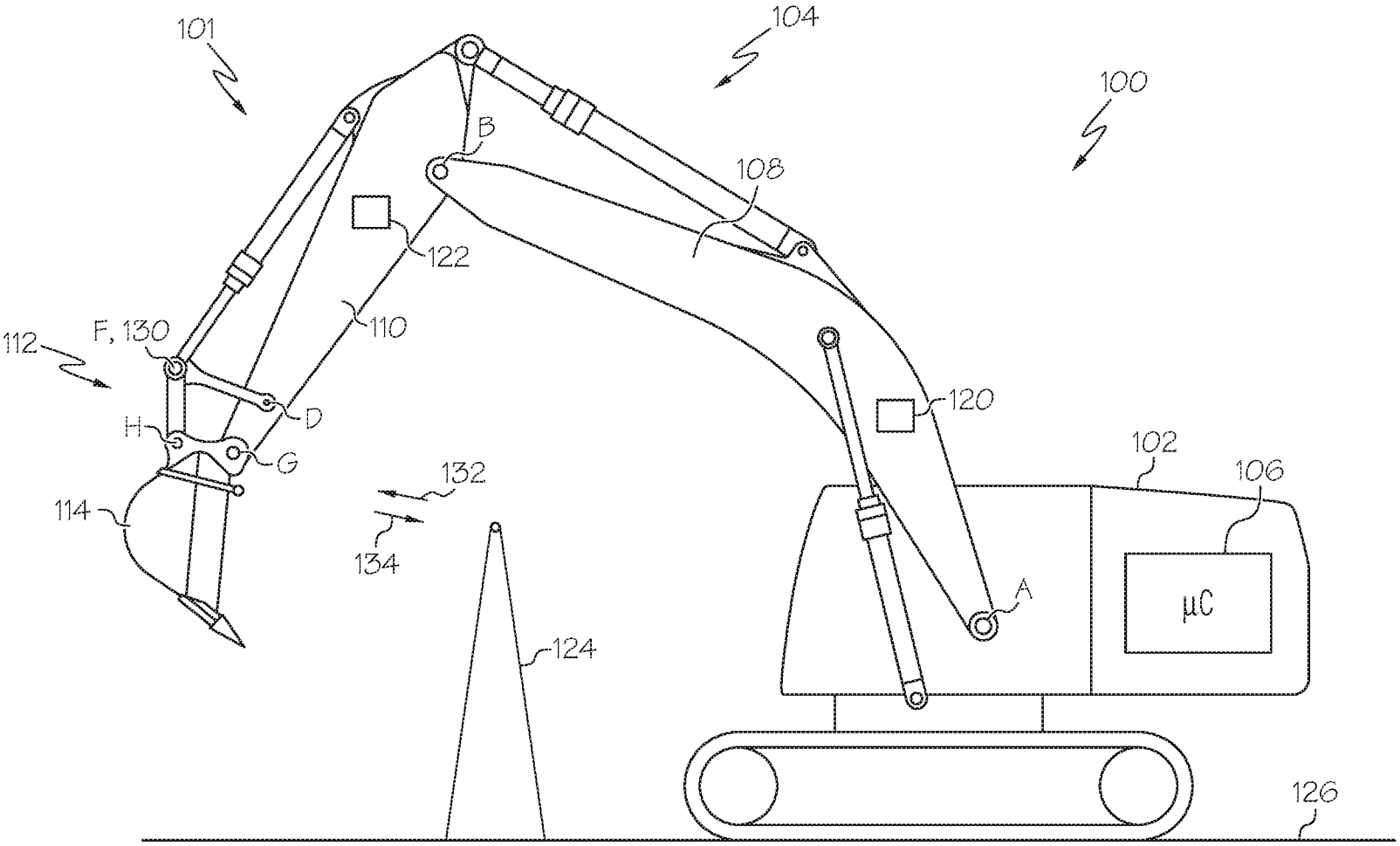
FIG. 1 is a side view of an excavator incorporating aspects of the present disclosure.

Referring initially to FIG. 1, an excavator calibration framework 101 comprises an excavator 100, a laser distance meter (LDM) 124, and a laser reflector 130. The excavator 100 comprises a machine chassis 102, an excavating linkage assembly 104, an excavating implement 114, and control architecture 106. The excavating linkage assembly 104 comprises an excavator boom 108, and an excavator stick 110, and a four-bar linkage 112 that collectively define a plurality of linkage assembly positions.

The excavator stick 110 is mechanically coupled to a terminal pivot point B of the excavator boom 108. The machine chassis 102 is mechanically coupled to a terminal pivot point A of the excavator boom 108. A position of the terminal pivot point B with respect to the terminal pivot point A may be identified and utilized as an input. Further, the excavating implement 114 and the excavator stick 110 are mechanically coupled to each other through the four-bar linkage 112.

The four-bar linkage comprises a first node, a second node, a third node, and a fourth node with linkages disposed therebetween, the linkage disposed between the first node and the second node comprising a dogbone linkage. In embodiments, the first node is a node D of the four-bar linkage, the second node is a node F of the four-bar linkage, the third node is a node G of the four-bar linkage, and the fourth node is a node H of the four-bar linkage. As a non-limiting example, the four-bar linkage 112 comprises a node D, a node F, a node G, and a node H, and linkages disposed therebetween. The linkage between the nodes D and F defines a dogbone linkage. In embodiments, the node D, the node F, the node H, and the node G of the four-bar linkage 112 comprise a bucket linkage GH between the node G and the node H, a rear side linkage FH between the node F and the node H, the dogbone linkage DF between the node D and the node F, and a front side linkage GD between the node G and the node D. In embodiments, lengths of each of the linkages of the four-bar linkage 112 may be identified for utilization as an input. A position of the node G with respect to the terminal pivot point A may be identified such that a first length BG between the node G and the terminal pivot point B is identified and utilized as an input.

The LDM 124 is configured to generate one or more measurement signals indicative of a distance and an angle between the LDM 124 and the laser reflector 130. In embodiments, the laser reflector 130 is on a pole or secured directly to the node F. The LDM 124 may be, for example, a Bosch GLM 100C LDM as made commercially available by Robert Bosch GmbH of Germany. A laser signal from the LDM 124, which is placed on ground 126, may be transmitted in a direction of an arrow 132 to the calibration node and an aligned laser reflector, and the laser signal may be reflected back to the LDM 124 in the direction of an arrow 134, as illustrated in FIG. 1.

The excavator stick 110 comprises a terminal point and is mechanically coupled to the excavating implement 114 through the terminal point. The four-bar linkage 112 and the excavator stick 110 are mechanically coupled to the excavating implement 114 through the terminal point. The node G is disposed at a position corresponding to the terminal point of the excavator stick 110 to which the excavator stick 110 is coupled to the excavating implement 114.

Figure 4:
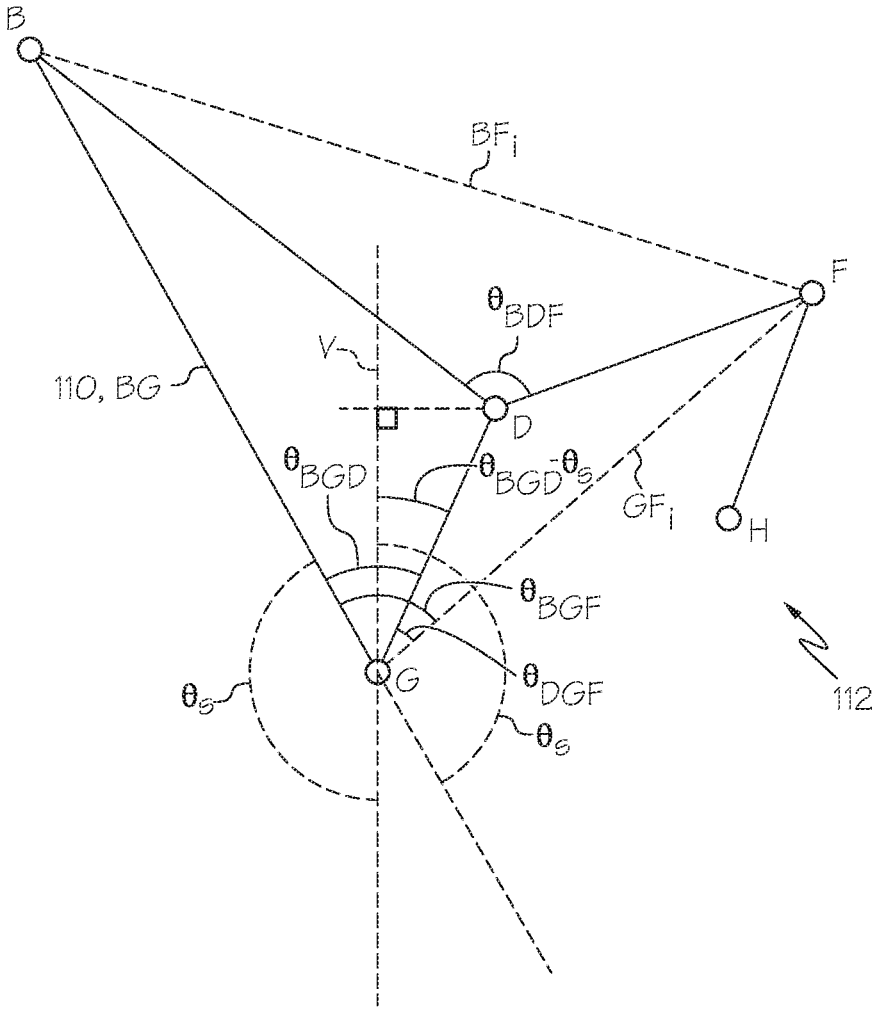
FIG. 4 is a side elevation view of a four-bar linkage assembly of the excavator of FIG. 1, according to various concepts of the present disclosure.

An outer triangle is defined between the terminal pivot point B, the second node, and the third node of the four-bar linkage 112. The outer triangle comprises a first length between the terminal pivot point B and the third node of the four-bar linkage 112, a second length between the terminal pivot point B and the second node of the four-bar linkage 112, and a third length between the second node and third node of the four-bar linkage 112. For example, referring to FIG. 4, an outer triangle BGF is defined between the node F, the terminal pivot point B, and the node G. The outer triangle BGF comprises a first length BG, a second length $BF_i$, a third length $GF_i$.

The first node of the four-bar linkage 112 is positioned within the outer triangle and defines, with the outer triangle, three inner triangles comprising a first inner triangle, a second inner triangle, and a third inner triangle within the outer triangle. For example, the node D is positioned within the outer triangle BGF and defines, with the outer triangle BGF, three inner triangles DGB, DBF, and DFG within the outer triangle BGF.

The control architecture 106 comprises one or more linkage assembly actuators and an architecture controller programmed to execute an iterative process. In embodiments, the control architecture 106 comprises a non-transitory computer-readable storage medium comprising machine readable instructions. The one or more linkage assembly actuators may facilitate movement of the excavating linkage assembly 104. The one or more linkage assembly actuators may comprise a hydraulic cylinder actuator, a pneumatic cylinder actuator, an electrical actuator, a mechanical actuator, or combinations thereof.

In embodiments, the iterative process comprises determining a position of the node F based on a generated measurement signal indicative of a distance and an angle between the LDM 124 and the laser reflector 130, determining a position of the node D at least partially based on the position of the node F, and determining a dogbone angle BDF of the inner triangle DBF at least partially based on the position of the node D.

Figure 5:
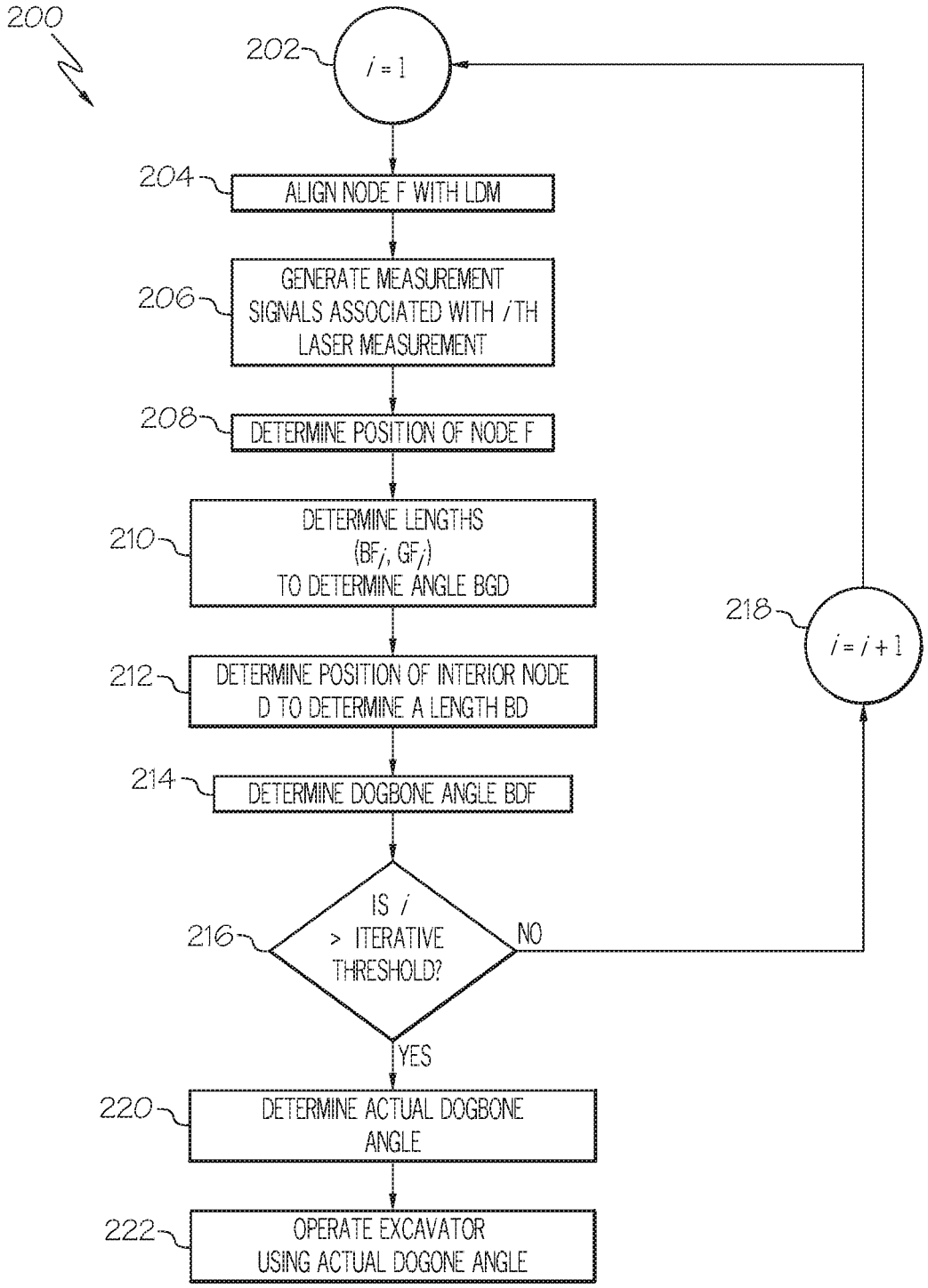
FIG. 5 is a flow chart of a process used to determine an angle of a linkage of the four-bar linkage assembly of the excavator of FIG. 1.

As a non-limiting example, steps 202-218 of a control scheme 200 of FIG. 5 illustrate the iterative process. In step 202, the iterative process, which applies an ith laser measurement, starts with i=1 for a 1st laser measurement. The iterative process comprises disposing the laser reflector 130 at a position corresponding to the node F (that may be, for example, the second node of the four-bar linkage 112). In step 202, the iterative process comprises moving the excavating linkage assembly 104 to align the node F with the LDM 124. In step 206, the iterative process comprises generating a measurement signal indicative of a distance and an angle between the LDM 124 and the laser reflector 130.

In step 208, the iterative process comprises determining a position of the node F based on the generated measurement signal. In embodiments, determining a position of the node F based on the generated measurement signal comprises determining a height $\hat{H}$ and a distance $\hat{D}$ between the node F and the LDM 124 based on a LDM distance signal $D_{LDM}$ and an angle of inclination signal $\theta_{INC}$, such that $$\hat{D}=D_{LDM}\cos(\theta_{INC}),\text{ and}$$

$$\hat{H}=D_{LDM}\sin(\theta_{INC});\qquad\text{(Equations 1-2)}$$

Equations 1-2 above include an offset horizontal distance ($D_0$) and an offset vertical distance ($H_0$) between the terminal pivot point A of the excavator boom 108 and a laser origin of the LDM 124.

In step 210, the iterative process comprises determining the second length $BF_i$ and the third length $GF_i$ of the outer triangle BGF at least partially based on the position of the node F. Determining the second length $BF_i$ and the third length $GF_i$ of the outer triangle may at least be partially based on the position of the node F, the position of the terminal pivot point B, and the position of the node G. As a non-limiting example, for an ith iteration, the second length $BF_i$ is a distance between the terminal pivot point B and the node F, and the third length $GF_i$ is a distance between the node G and the node F.

The iterative process may further comprise determining a first inner triangle angle of one of the first inner triangle defined between the terminal pivot point B, the terminal point G of the excavator stick, and the first node of the four-bar linkage at least partially based on the second length and the third length of the outer triangle. For example, through step 210, the iterative process further comprises determining an angle BGD ($\theta_{BGD}$) of the inner triangle DGB at least partially based on the second length $BF_i$, and the third length $GF_i$ of the outer triangle BGF. In embodiments, determining an angle BGD ($\theta_{BGD}$) is further based on determining an angle BGF ($\theta_{BGF}$) of the outer triangle BGF and an angle DGF ($\theta_{DGF}$) of the inner triangle DFG. The angle BGF ($\theta_{BGF}$) of the outer triangle BGF is based on the first length BG, the second length $BF_i$, and the third length $GF_i$, and application of a law of cosines. For example, determining the angle BGF ($\theta_{BGF}$) of the outer triangle BGF comprises use of a following equation:

$$\cos(\theta_{BGF})=\frac{GF_i^2+BG^2-BF_i^2}{2*GF_i*BG}\qquad\text{(Equation 3)}$$

Determining an angle DGF ($\theta_{DGF}$) of the inner triangle DFG may be based on the law of cosines and a set of legs defining the inner triangle DFG, the set of legs comprising the dogbone linkage, the third length $GF_i$, and a length GD. For example, the angle DGF ($\theta_{DGF}$) of the inner triangle DFG is based on a length DG, a length DF, and the third length $GF_i$, and application of the law of cosines. Determining the angle DGF ($\theta_{DGF}$) of the inner triangle DFG comprises use of a following equation:

$$\cos(\theta_{DGF}) = \frac{GF_i^2 + DG^2 - DF^2}{2 * GF_i * DG} \quad \text{(Equation 4)}$$

The angle DGF ($\theta_{DGF}$) is subtracted from the angle BGF ($\theta_{BGF}$) to determining the angle BGD ($\theta_{BGD}$) of the inner triangle DGB. In step 212, the iterative process comprises determining a position of the node D (that may be, for example, the first node of the four-bar linkage 112) at least partially based on the angle BGD ($\theta_{BGD}$) as the first inner triangle angle. As a non-limiting example, determining the position of the node D comprises determining a horizontal distance $D_x$ and a vertical distance $D_y$ between the node D and the terminal pivot point A of the excavator boom at least partially based on the angle BGD ($\theta_{BGD}$) and a horizontal distance $G_x$ and a vertical distance $G_y$ between the node G and the terminal pivot point A of the excavator boom, through a following set of equations:

$$D_y = G_y - \sin(\theta_{BGD} - \theta_S) * GD, \text{ and}$$

$$D_x = G_x - \cos(\theta_{BGD} - \theta_S) * GD; \quad \text{(Equations 5-6)}$$

In Equations 5-6 above, $\theta_S$ is angle of the excavator stick 110 with respect to vertical V. Through step 212, the iterative process further comprises determining a length BD (as, for example, an inner length) along the excavator stick 110 between the terminal pivot point B and the node D at least partially based on the position of the node D.

In step 214, the iterative process comprises determining a dogbone angle BDF ($\theta_{BDF}$) of the inner triangle DBF (which may be, for example, the second inner triangle) based on the length BD along the excavator stick 110, a dogbone length DF of the dogbone linkage of the four-bar linkage 112, and the second length $BF_i$ of the outer triangle BGF. Determining the dogbone angle BDF ($\theta_{BDF}$) of the inner triangle DBF is further based on the law of cosines. The dogbone angle BDF ($\theta_{BDF}$) corresponds to an angular orientation of the dogbone linkage with respect to the length BD along the excavator stick 110.

In step 216, if i is not greater than an iterative threshold, then the iterative process proceeds to step 218 to advance to the next iteration (for example, next ith laser measurement) and is repeated through steps 204-216. The architecture controller is programmed to repeat the iterative process i times until i passes the iterative threshold. If, in step 216, i is greater than the iterative threshold, then the control scheme 200 advances to the step 220 to determine an actual dogbone angle ($\theta_{BDF}^{actual}$). For example, in step 220, the architecture controller is further programmed to generate the actual dogbone angle BDF ($\theta_{BDF}^{actual}$) based on a series of dogbone angles BDF determined from the iterative process. Further, in step 222, the architecture controller is further programmed to operate the excavator using the actual dogbone angle ($\theta_{BDF}^{actual}$).

Figure 2:
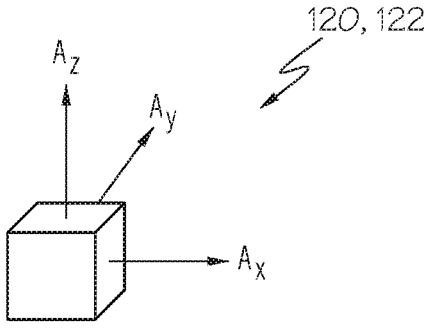
FIG. 2 is a perspective view of a dynamic sensor disposed on a linkage of the excavator of FIG. 1 and according to various concepts of the present disclosure.
Figure 3:
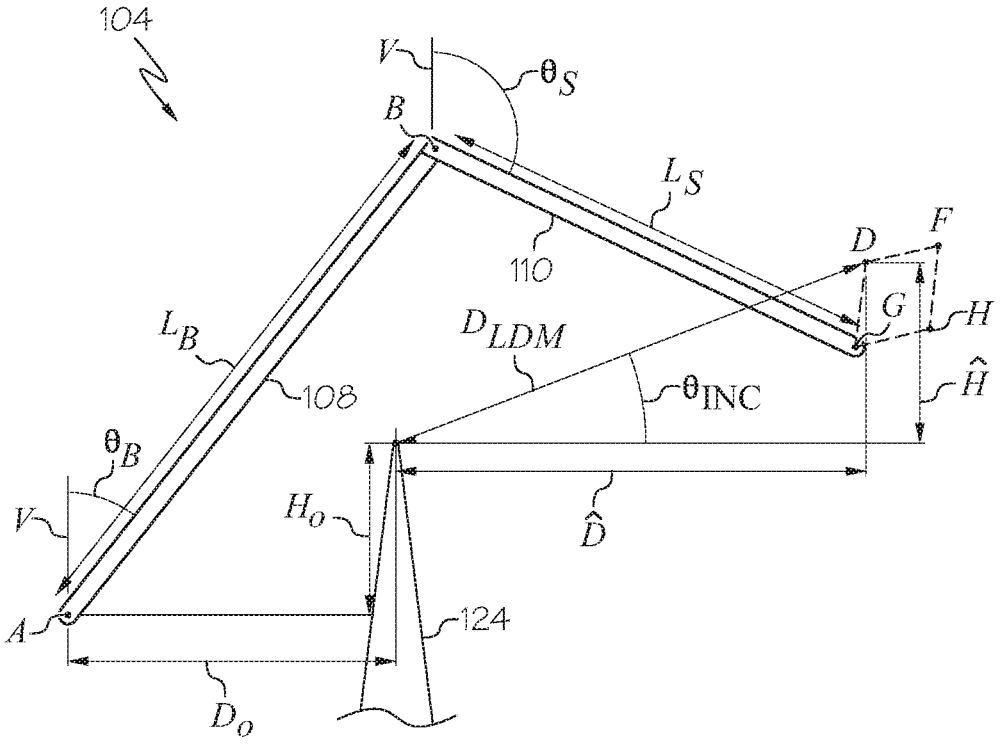
FIG. 3 is a side elevation view of a linkage assembly of an excavator calibration framework including a laser distance meter (LDM) and implement dimension points of an excavating implement of the excavator of FIG. 1.

In embodiments, one or more dynamic sensors may include the implement sensor and dynamic sensors 120, 122 positioned on other excavator limbs such as the excavator boom 108 and the excavator stick 110, which are similar to the implement dynamic sensor. The one or more dynamic sensors may comprise an inertial measurement unit (IMU), an inclinometer, an accelerometer, a gyroscope, an angular rate sensor, a rotary position sensor, a position sensing cylinder, or combinations thereof. The IMU may comprise a 3-axis accelerometer and a 3-axis gyroscope. As shown in FIG. 2, the dynamic sensors 120, 122 include accelerations $A_x$, $A_y$, and $A_z$, respectively representing x-axis, y-axis-, and z-axis acceleration values In an embodiment, the implement dynamic sensor is disposed on the dogbone linkage DF to generate a measured dogbone angle signal ($\theta_{BDF}^{measured}$). The actual dogbone angle BDF ($\theta_{BDF}^{actual}$) is compared with the measured dogbone angle signal to generate an offset dogbone angle ($\theta_{BDF}^{bias}$) based on a following equation:

$$\theta_{BDF}^{bias} = \theta_{BDF}^{actual} - \theta_{BDF}^{measured}. \quad \text{(Equation 7)}$$

The implement dynamic sensor may be calibrated based on the offset dogbone angle ($\theta_{BDF}^{bias}$) to remove a bias due to the offset dogbone angle ($\theta_{BDF}^{bias}$).

It is contemplated that the embodiments of the present disclosure may assist to permit a speedy and more cost efficient method of determining dimensions such as an dogbone linkage angle of a four-bar linkage, and methods to determine and calibrate sensor offsets of sensors on excavator linkages, in a manner that minimizes a risk of human error with such value determinations. Further, the controller of the excavator or other control technologies are improved such that the processing systems are improved and optimized with respect to speed, efficiency, and output.

A signal may be "generated" by direct or indirect calculation or measurement, with or without the aid of a sensor.

For the purposes of describing and defining the present invention, it is noted that reference herein to a variable being a "function" of a parameter or another variable is not intended to denote that the variable is exclusively a function of the listed parameter or variable. Rather, reference herein to a variable that is a "function" of a listed parameter is intended to be open ended such that the variable may be a function of a single parameter or a plurality of parameters.

It is also noted that recitations herein of "at least one" component, element, etc., should not be used to create an inference that the alternative use of the articles "a" or "an" should be limited to a single component, element, etc.

It is noted that recitations herein of a component of the present disclosure being "configured" or "programmed" in a particular way, to embody a particular property, or to function in a particular manner, are structural recitations, as opposed to recitations of intended use. More specifically, the references herein to the manner in which a component is "configured" or "programmed" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

For the purposes of describing and defining the present invention it is noted that the terms "substantially" and "approximately" are utilized herein to represent the inherent degree of uncertainty that may be attributed to any quantitative comparison, value, measurement, or other representation. The terms "substantially" and "approximately" are also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. An excavator calibration framework comprising an excavator, a laser distance meter (LDM), and a laser reflector, wherein:

the excavator comprises a machine chassis, an excavating linkage assembly, an excavating implement, and control architecture;

the excavating linkage assembly comprises an excavator boom, and an excavator stick, and a four-bar linkage that collectively define a plurality of linkage assembly positions;

the excavator stick is mechanically coupled to a terminal pivot point B of the excavator boom;

the four-bar linkage comprises a node D, a node F, a node G, and a node H, and linkages disposed therebetween, the linkage between the nodes D and F defining a dogbone linkage;

the LDM is configured to generate one or more measurement signals indicative of a distance and an angle between the LDM and the laser reflector;

an outer triangle BGF is defined between the node F, the terminal pivot point B, and the node G;

the outer triangle BGF comprises a first length BG, a second length $BF_i$, a third length $GF_i$;

the node D is positioned within the outer triangle BGF and defines, with the outer triangle BGF, three inner triangles DGB, DBF, and DFG within the outer triangle BGF;

the control architecture comprises one or more linkage assembly actuators and an architecture controller programmed to execute an iterative process, the iterative process comprising:

disposing the laser reflector at a position corresponding to the node F;

generating a measurement signal indicative of a distance and an angle between the LDM and the laser reflector;

determining a position of the node F based on the generated measurement signal;

determining the second length $BF_i$ and the third length $GF_i$ of the outer triangle BGF at least partially based on the position of the node F;

determining an angle BGD ($\theta_{BGD}$) of the inner triangle DGB at least partially based on the second length $BF_i$, and the third length $GF_i$ of the outer triangle BGF;

determining a position of the node D at least partially based on the angle BGD ($\theta_{BGD}$);

determining a length BD along the excavator stick between the terminal pivot point B and the node D at least partially based on the position of the node D; and determining a dogbone angle BDF ($\theta_{BDF}$) of the inner triangle DBF based on the length BD along the excavator stick, a dogbone length DF of the dogbone linkage of the four-bar linkage, and the second length $BF_i$ of the outer triangle BGF, the dogbone angle BDF ($\theta_{BDF}$) corresponding to an angular orientation of the dogbone linkage with respect to the length BD along the excavator stick; and the architecture controller is further programmed to:

repeat the iterative process i times until i passes an iterative threshold;

generate an actual dogbone angle BDF ($\theta_{BDF}^{actual}$) based on a series of dogbone angles BDF determined from the iterative process; and operate the excavator using the actual dogbone angle ($\theta_{BDF}^{actual}$).

2. An excavator calibration framework as claimed in claim 1, wherein determining the angle BGD ($\theta_{BGD}$) of the inner triangle DGB at least partially based on the second length $BF_i$, and the third length $GF_i$ of the outer triangle BGF is further based on:

determining an angle BGF ($\theta_{BGF}$) of the outer triangle BGF and an angle DGF ($\theta_{DGF}$) of the inner triangle DFG, wherein:

the angle BGF ($\theta_{BGF}$) of the outer triangle BGF is based on the first length BG, the second length $BF_i$, and the third length $GF_i$, and a law of cosines; and the angle DGF ($\theta_{DGF}$) of the inner triangle DFG is based on a length DG, a length DF, and the third length $GF_i$, and the law of cosines.

3. An excavator calibration framework as claimed in claim 1, wherein the iterative process comprising moving the excavating linkage assembly to align the node F with the LDM.

4. An excavator calibration framework as claimed in claim 1, wherein determining a position of the node F based on the generated measurement signal comprises determining a height $\hat{H}$ and a distance $\hat{D}$ between the node F and the LDM based on a LDM distance signal $D_{LDM}$ and an angle of inclination signal $\theta_{INC}$, such that $$\hat{D}=D_{LDM}\cos(\theta_{INC}),\text{ and}$$

$$\hat{H}=D_{LDM}\sin(\theta_{INC});$$

including an offset horizontal distance ($D_0$) and an offset vertical distance ($H_0$) between the terminal pivot point A of the excavator boom and a laser origin of the LDM.

5. An excavator calibration framework as claimed in claim 1, wherein:

the machine chassis is mechanically coupled to a terminal pivot point A of the excavator boom;

a position of the terminal pivot point B with respect to the terminal pivot point A is identified;

a position of the node G with respect to the terminal pivot point A is identified such that a first length BG between the node G and the terminal pivot point B is identified.

6. An excavator calibration framework as claimed in claim 5, wherein determining the second length $BF_i$ and the third length $GF_i$ of the outer triangle is at least partially based on the position of the node F, the position of the terminal pivot point B, and the position of the node G, such that, for an ith iteration:

the second length $BF_i$ is a distance between the terminal pivot point B and the node F; and the third length $GF_i$ is a distance between the node G and the node F.

7. An excavator calibration framework as claimed in claim 6, wherein determining the angle BGD ($\theta_{BGD}$) of the inner triangle DGB at least partially based on the second length $BF_i$, and the third length $GF_i$ of the outer triangle comprises:

determining an angle BGF ($\theta_{BGF}$) of the outer triangle BGF based on the first length BG, the second length $BF_i$, the third length $GF_i$, and a law of cosines;

determining an angle DGF ($\theta_{DGF}$) of the inner triangle DFG based on the law of cosines and a set of legs defining the inner triangle DFG, the set of legs comprising the dogbone linkage, the third length $GF_i$, and a length GD; and subtracting the angle DGF ($\theta_{DGF}$) from the angle BGF ($\theta_{BGF}$).

8. An excavator calibration framework as claimed in claim 7, wherein determining the position of the node D comprises:

determining a horizontal distance $D_x$ and a vertical distance $D_y$ between the node D and the terminal pivot point A of the excavator boom at least partially based on the angle BGD ($\theta_{BGD}$) and a horizontal distance $G_x$ and a vertical distance $G_y$ between the node G and the terminal pivot point A of the excavator boom, through a following set of equations:

$$D_y=G_y-\sin(\theta_{BGD}-\theta_S)*GD, \text{ and}$$

$$D_x=G_x-\cos(\theta_{BGD}-\theta_S)*GD;$$

where $\theta_S$ is angle of the excavator stick with respect to vertical V.

9. An excavator calibration framework as claimed in claim 8, wherein determining the dogbone angle BDF ($\theta_{BDF}$) of the inner triangle DBF is further based on the law of cosines.

10. An excavator calibration framework as claimed in claim 1, wherein:

an implement dynamic sensor is disposed on the dogbone linkage to generate a measured dogbone angle signal ($\theta_{BDF}^{measured}$); and the actual dogbone angle BDF ($\theta_{BDF}^{actual}$) is compared with the measured dogbone angle signal to generate an offset dogbone angle ($\theta_{BDF}^{bias}$) based on a following equation:

$$\theta_{BDF}^{bias}=\theta_{BDF}^{actual}-\theta_{BDF}^{measured}.$$

11. An excavator calibration framework as claimed in claim 10, wherein the implement dynamic sensor is calibrated based on the offset dogbone angle ($\theta_{BDF}^{bias}$) to remove a bias due to the offset dogbone angle ($\theta_{BDF}^{bias}$).

12. An excavator calibration framework as claimed in claim 1, wherein:

the excavator stick comprises a terminal point and is mechanically coupled to the excavating implement through the terminal point;

the four-bar linkage and the excavator stick are mechanically coupled to the excavating implement through the terminal point; and the node G is disposed at a position corresponding to the terminal point of the excavator stick to which the excavator stick is coupled to the excavating implement.

13. An excavator calibration framework comprising an excavator, a laser distance meter (LDM), and a laser reflector, wherein:

the excavator comprises a machine chassis, an excavating linkage assembly, an excavating implement, and control architecture;

the excavating linkage assembly comprises an excavator boom, and an excavator stick, and a four-bar linkage that collectively define a plurality of linkage assembly positions;

the excavator stick is mechanically coupled to a terminal pivot point B of the excavator boom;

the four-bar linkage comprises a first node, a second node, a third node, and a fourth node with linkages disposed therebetween, the linkage disposed between the first node and the second node comprising a dogbone linkage;

the LDM is configured to generate one or more measurement signals indicative of a distance and an angle between the LDM and the laser reflector;

an outer triangle is defined between the second node, the terminal pivot point B, and the third node;

the outer triangle comprises a first length between the terminal pivot point B and the third node of the four-bar linkage, a second length between the terminal pivot point B and the second node of the four-bar linkage, and a third length between the second node and the third node of the four-bar linkage;

the first node is positioned within the outer triangle and defines, with the outer triangle, three inner triangles comprising a first inner triangle, a second inner triangle, and a third inner triangle within the outer triangle;

the control architecture comprises one or more linkage assembly actuators and an architecture controller programmed to execute an iterative process, the iterative process comprising:

disposing the laser reflector at a position corresponding to the second node of the four-bar linkage;

generating a measurement signal indicative of a distance and an angle between the LDM and the laser reflector;

determining a position of the second node of the four-bar linkage based on the generated measurement signal;

determining the second length and the third length of the outer triangle at least partially based on the position of the second node of the four-bar linkage;

determining a first inner triangle angle of one of the first inner triangle defined between the terminal pivot point B, the terminal point G of the excavator stick, and the first node of the four-bar linkage at least partially based on the second length and the third length of the outer triangle;

determining a position of the first node of the four-bar linkage at least partially based on the first inner triangle angle;

determining an inner length along the excavator stick between the terminal pivot point B and the first node of the four-bar linkage at least partially based on the position of the first node of the four-bar linkage; and determining a dogbone angle defined by the second inner triangle, the second inner triangle formed from the inner length along the excavator stick, a dogbone length of the dogbone linkage of the four-bar linkage, and the second length of the outer triangle, the dogbone angle corresponding to an angular orientation of the dogbone linkage with respect to the inner length along the excavator stick; and the architecture controller is further programmed to:

repeat the iterative process i times until i passes an iterative threshold;

generate an actual dogbone angle based on a series of dogbone angles determined from the iterative process; and operate the excavator using the actual dogbone angle.

14. An excavator calibration framework as claimed in claim 13, wherein the first node is a node D of the four-bar linkage, the second node is a node F of the four-bar linkage, the third node is a node G of the four-bar linkage, and the fourth node is a node H of the four-bar linkage.

15. An excavator calibration framework as claimed in claim 14, wherein the outer triangle is a triangle BGF, the first length of the outer triangle is a first length BG, the second length of the outer triangle is a second length $BF_i$, and the third length of the outer triangle is a third length $GF_i$.

16. An excavator calibration framework as claimed in claim 15, wherein:

the first inner triangle comprises an inner triangle DGB, the second inner triangle comprises an inner triangle DBF, and the third inner triangle comprises an inner triangle DFG;

the first inner triangle angle comprises an angle BGD of the inner triangle DGB; and the dogbone angle comprises a dogbone angle BDF of the inner triangle DBF.

17. An excavator calibration framework comprising an excavator, a laser distance meter (LDM), and a laser reflector, wherein:

the excavator comprises a machine chassis, an excavating linkage assembly, an excavating implement, and control architecture;

the excavating linkage assembly comprises an excavator boom, and an excavator stick, and a four-bar linkage that collectively define a plurality of linkage assembly positions;

the excavator stick is mechanically coupled to a terminal pivot point B of the excavator boom;

the four-bar linkage comprises a node D, a node F, a node G, and a node H, and linkages disposed therebetween, the linkage between the nodes D and F defining a dogbone linkage, the laser reflector disposed at a position corresponding to the node F, the nodes F, G, and the terminal pivot point B defining an outer triangle BGF, and the node D positioned within the outer triangle BGF to define three inner triangles DGB, DBF, and DFG;

the LDM is configured to generate one or more measurement signals indicative of a distance and an angle between the LDM and the laser reflector;

the control architecture comprises one or more linkage assembly actuators and an architecture controller programmed to execute an iterative process, the iterative process comprising:

determining a position of the node F based on a generated measurement signal indicative of a distance and an angle between the LDM and the laser reflector;

determining a position of the node D at least partially based on the position of the node F;

determining a dogbone angle BDF of the inner triangle DBF at least partially based on the position of the node D; and the architecture controller is further programmed to:

repeat the iterative process i times until i passes an iterative threshold;

generate an actual dogbone angle BDF based on a series of dogbone angles BDF determined from the iterative process; and operate the excavator using the actual dogbone angle.

18. An excavator calibration framework as claimed in claim 17, wherein:

the outer triangle BGF comprises a first length BG, a second length $BF_i$, a third length $GF_i$; and determining a position of the node D at least partially based on the position of the node F comprises:

determining the second length $BF_i$ and the third length $GF_i$ of the outer triangle at least partially based on the position of the node F;

determining an angle BGD of one of the inner triangles DGB at least partially based on the second length $BF_i$, and the third length $GF_i$ of the outer triangle; and determining a position of the node D at least partially based on the angle BGD.

19. An excavator calibration framework as claimed in claim 18, wherein determining a dogbone angle BDF of another of the inner triangles DBF at least partially based on based on the position of the node D comprises:

determining a length BD between the terminal pivot point B and the node D at least partially based on the position of the node D; and determining a dogbone angle BDF of another of the inner triangles DBF at least partially based on based on the length BD, a dogbone length DF of the dogbone linkage of the four-bar linkage, and the second length $BF_i$ of the outer triangle BGF.

20. An excavator calibration framework as claimed in claim 17, wherein:

the machine chassis is mechanically coupled to a terminal pivot point A of the excavator boom;

a position of the terminal pivot point B with respect to the terminal pivot point A is identified;

a position of the node G with respect to the terminal pivot point A is identified such that a first length BG between the node G and the terminal pivot point B is identified.

* * * * *